US005280878A

United States Patent [19]

Terao et al.

[11] Patent Number: 5,280,878

[45] Date of Patent: Jan. 25, 1994

[54] PLATE BRICK FOR SLIDING GATE VALVE

[75] Inventors: Masaru Terao, Okayama; Harumi Kamegawa, Bizen; Hiroshi Inoue, Kokubunji, all of Japan

[73] Assignee: Shinagawa Refractories Co., Ltd., Tokyo, Japan

[21] Appl. No.: 929,334

[22] Filed: Aug. 14, 1992

Related U.S. Application Data

[63] Continuation-in-part of Ser. No. 814,786, Dec. 31, 1991, abandoned.

[51] Int. Cl.[5] ..... F16K 3/314

[52] U.S. Cl. ..... 251/326; 222/600

[58] Field of Search ..... 251/326, 327, 329; 137/315; 222/600

[56] References Cited

U.S. PATENT DOCUMENTS 4,141,478 2/1979 Meier ..... 251/326 X
4,220,268 9/1980 Fehling ..... 251/326 X
4,508,324 4/1985 Lührsen ..... 222/600 X
4,840,296 6/1989 Otsuka et al. .
5,173,197 12/1992 Kleeblat ..... 222/600

FOREIGN PATENT DOCUMENTS 2122317 1/1984 United Kingdom ..... 251/326

*Primary Examiner*—Stephen M. Hepperle
*Attorney, Agent, or Firm*—Larson and Taylor

[57] ABSTRACT

A plate brick for a sliding gate valve provides a mechanism for preventing cracks which may occur in the abutting portion of a brick setting metal fitting. The plate brick comprises ends having a semicircular shape and an outer periphery which is strained with an iron plate hoop. The generation of cracks is reduced by providing slits or recesses at both ends of the plate at positions corresponding to those of the brick fixing metal fittings.

3 Claims, 5 Drawing Sheets

PRIOR ART

PLATE BRICK FOR SLIDING GATE VALVE

CROSS-REFERENCE TO RELATED APPLICATIONS

This patent application is a continuation-in-part of U.S. patent application No. 07/814,786, filed Dec. 31, 1991, now abandoned.

PRIOR ART

To prevent cracks which may be caused by means for fixing a plate brick, cracks which may be caused when using a plate brick into a support frame and possible expansion of the cracks and to improve working conditions when the plate brick is replaced, the plate bricks currently in use are ones whose outer side periphery is strained with a metal plate hoop.

U.K. Patent Application No. GB 2 122 317A relates to a plate assembly for a sliding gate valve for the outlet of a metallurgical vessel. The assembly comprises a support frame having an aperture therein accommodating a valve plate, a periphery of the plate being surrounded by a metallic casing or band, and clamping means serving to tension the casing or band around the periphery of the valve plate thereby biasing it into contact with the periphery. The clamping means is positively located with respect to both the casing or band and the support frame and thereby positively locates the valve plate in its own plane with respect to the support frame.

SUMMARY OF THE INVENTION

The present invention relates to a plate brick for a sliding gate valve of a type which is replaceable under on-line conditions.

The inventors have performed extensive research in an attempt to remove disadvantages in the plate bricks of such known system, and as a result they have developed the present invention. According to the invention, in a plate brick for a sliding gate valve, both ends in the sliding directions of said brick are of semicircular shape and the outer periphery of the brick strained with an iron plate hoop. At least one portion or recess is provided in a position corresponding to an arrangement of a brick setting metal fitting mounted to a plate fixing frame, and to said semicircular outer peripheral portions of the plate brick, wherein said setting metal fitting is an eccentric cam or a pressurizing fitting.

OBJECTS AND ADVANTAGES OF THE INVENTION

Conventionally, as illustrated in FIG. 8 for example, to secure a plate brick (2) bound with an iron plate hoop (1) to a housing or slide casing, a one-point supporting system using a brick setting metal fitting, such as a bolt clamping system, or eccentric cam system is employed. However, it is known that such a one-point supporting system has drawbacks in that cracks (5) occur in the plate brick (2) in a place near a position where a tip of the brick setting metal fitting abuts the iron plate hoop (1). FIG. 8 shows a plan view of an example of a side surface clamping system.

The object of the invention is to provide a mechanism for preventing cracks which may occur in the abutting portion of the brick setting metal fitting.

BRIEF DESCRIPTION OF DRAWINGS

The invention will now be described in more detail, by way of example, with reference to the accompanying drawings in which.

DETAILED DESCRIPTION OF PREFERRED EMBODIMENTS

Figure 1:
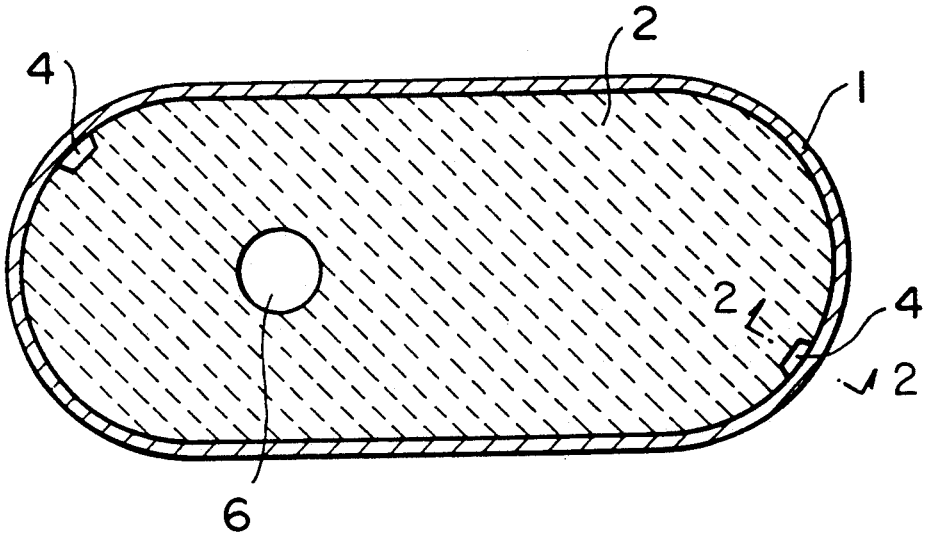
FIG. 1 is a plan view of a plate brick produced according to the invention.
Figure 2:
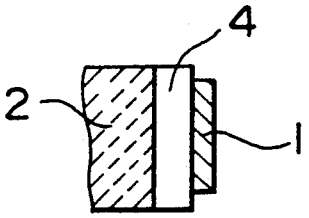
FIG. 2 is a sectional view taken along the line 2—2 of FIG. 1.

One embodiment of the invention will now be described with reference to the accompanying drawings.

As shown in the drawings, slits or recesses (4) are partially provided in a gate brick (2) for a sliding plate valve, the outer periphery of said brick being strained with an iron plate hoop (1). These slits or recesses (4) are provided at a suitable depth and width in the outer periphery of the plate brick (2), at places which correspond to the positions where the tips of the brick securing metal fittings (3) provided in a plate-mounting frame (7) for accommodating and retaining said plate brick (2), abut for clamping. Additionally, in the drawings reference numeral (6) designates a flow hole of molten metal, which is disposed in the plate brick (2).

Said slits or recesses (4) are provided at semicircular portions at both ends of said plate brick (2). Their positions correspond to those of the brick fixing metal fittings (3) provided in a plate mounting frame (7), and at least one slit or recess (4) is arranged in the outer periphery of the plate brick (2). Further, when a plurality of such slits or recesses (4) are arranged it has been found, as a result of experimentation that it is most suitable in terms of the clamping action of the iron plate hoop (1) to dispose the slits or recesses diagonally with respect to the center of said plate brick (2).

Though the fixing metal fittings (3) of the plate brick are illustrated with an eccentric cam, they are not limited to such eccentric cam, and any metal fitting which exerts a pressing action, such as a clamping bolt, will suffice. In the case of using a plurality of the fixing metal fittings it will also suffice to combine them with an eccentric cam and a pressing metal fitting.

Figure 3:
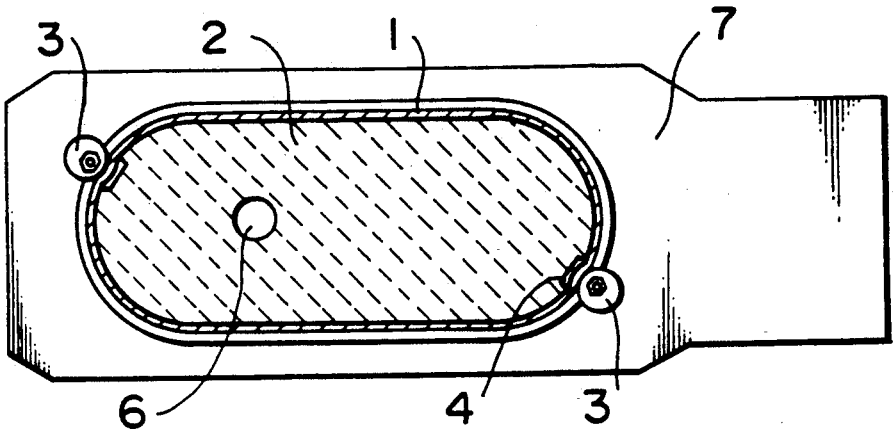
FIG. 3 is a plan view showing an embodiment in which a plate brick of the invention is secured to a frame with the aid of an eccentric cam.
Figure 4:
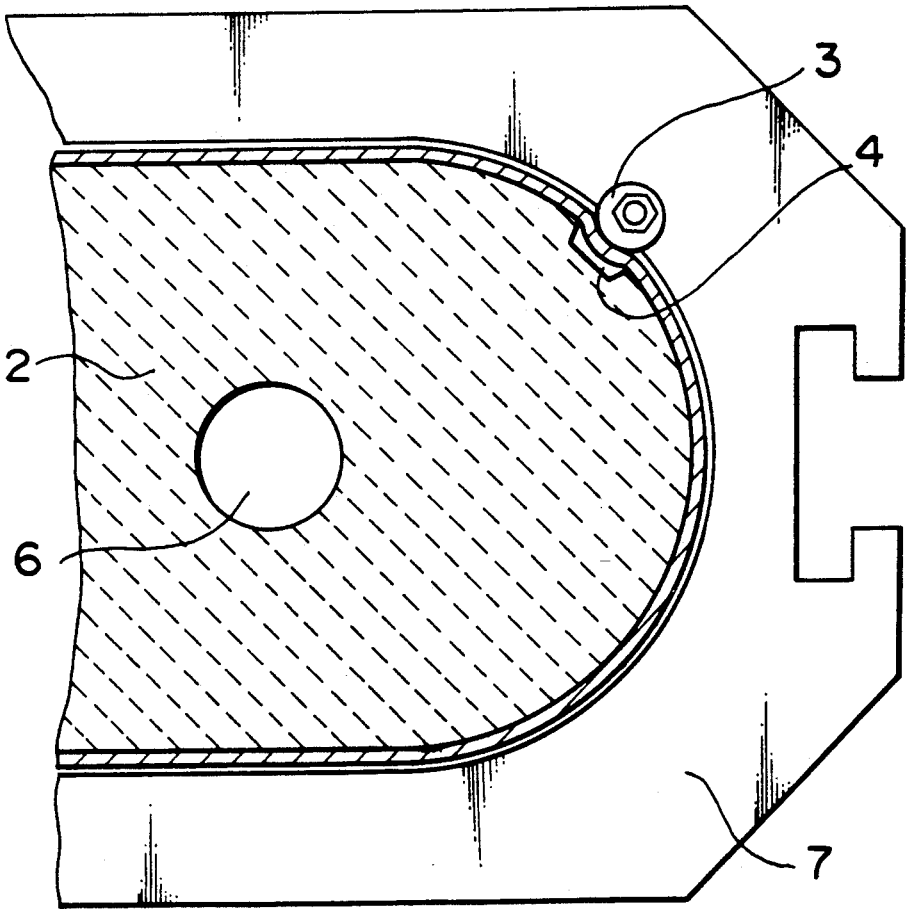
FIG. 4 is a partly enlarged plan view showing a relationship between the eccentric cam and the recess portion of the plate brick.
Figure 5:
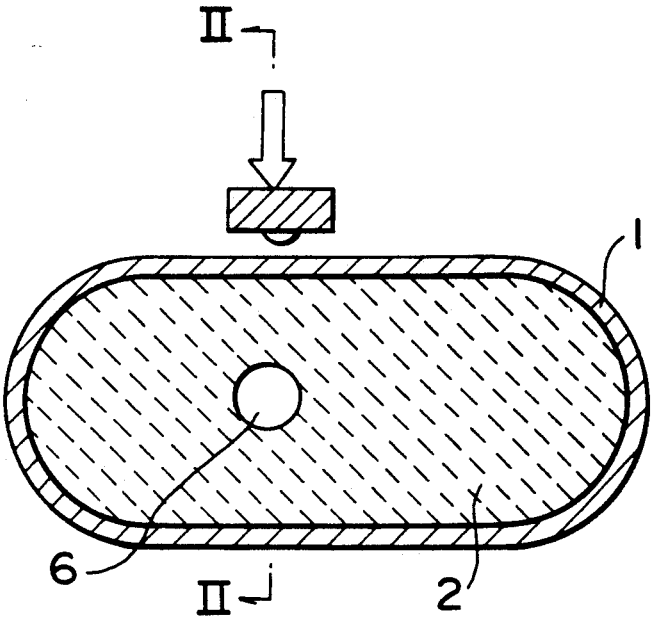
FIG. 5 is a plan view of a slit-free plate brick used for testing for generation of cracks.
Figure 6:
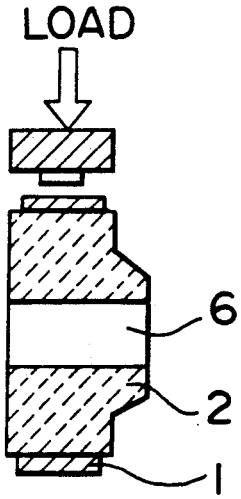
FIG. 6 is a lateral sectional view taken along the line II—II of FIG. 5.

Crack Generating Test:

With regard to a plate brick provided with slits as shown in FIGS. 1 and 3 according to the invention, and a slit-free plate brick as shown in FIGS. 5 and 6 according to a known system, tests for crack generation comparison were carried out. Conditions of the plate bricks thus tested were as follows:

Thickness of the iron plate hoop: 3.2 mm

Width of the slit: 20 mm

Depth of the slit: 7 mm

Figure 7:
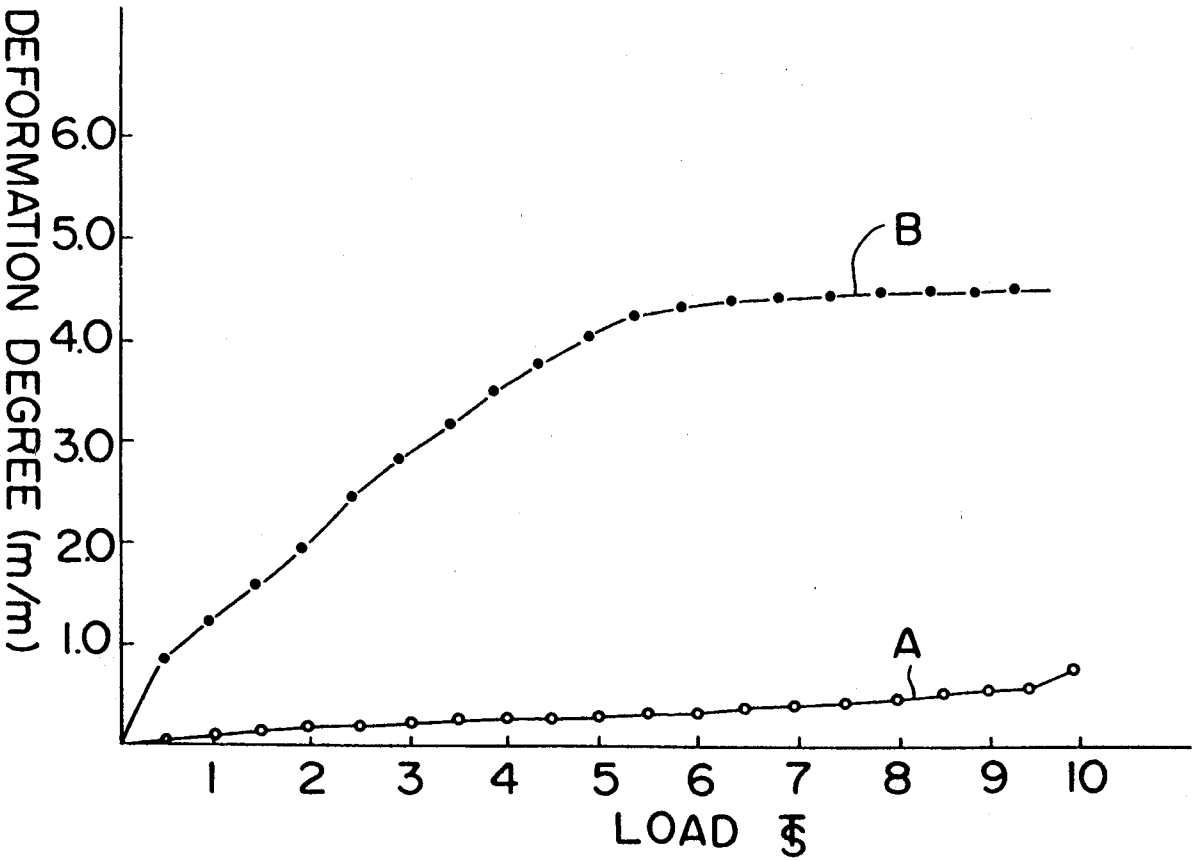
FIG. 7 is a graph showing results of a plate brick pressing test.
Figure 8:
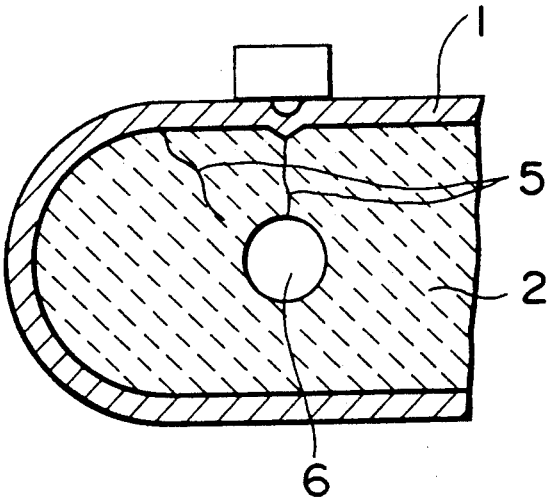
FIG. 8 is a plan view of a slit-free brick wherein cracks have generated after a pressing test.

FIG. 7 shows the results of the tests wherein in each of the plate bricks of the present invention and known system, pressure was applied from an outer direction of the iron plate hoop, and the degree of the deformation of each brick was plotted while taking load (t) as axis of abscissas and degree (mm) of deformation of the iron plate hoop as axis of ordinates. That is, as shown in FIG. 8, cracks occurred in the conventional slit-free article under only 9.5 t pressure, when the deformation degree of the hoop was observed to be less than 1 mm (curve A). Referring to the article manufactured according to the present invention, as will be seen from curve B, the cracks (5) were not observed in the plate brick (2) even if the article was subject to a pressure higher than 10 t and the degree of deformation of the iron plate hoop reached as high as 4.5 mm.

By constructing the plate brick for a sliding gate valve like the article of the present invention, the generation of cracks in the plate brick decreased to a large extent, and the life of the brick was improved by 30 to 50% compared with conventional articles.

We claim:

1. A plate brick for a sliding gate valve, both of the ends of the brick, in the sliding direction of the brick, being of semi-circular shape, and the outer periphery of the brick being strained with a metal hoop, said brick being provided with at least a pair of slit recesses, each recess of said pair of recesses being located at the outer periphery of the brick at a position on said semi-circular end portion of the brick and being located diagonally opposite to the other of said pair of recesses with respect to the center of said brick.

2. A plate brick according to claim 1, further comprising a plate fixing frame having an aperature therein accommodating said plate brick, said frame comprising metal fittings which engage the periphery of the brick to secure the brick in position in said aperature, and wherein said recesses are positioned at locations where said metal fittings engage the brick.

3. A plate brick according to claim 2, wherein each of said metal fittings comprises an eccentric ram, or a pressurizing fitting.

* * * * *